US005432295A

United States Patent [19]

Matsunaga et al.

[11] Patent Number: 5,432,295

[45] Date of Patent: Jul. 11, 1995

[54] PLAY DATA RECORDING APPARATUS FOR KEYED MUSICAL INSTRUMENT

[75] Inventors: Hiroshi Matsunaga; Tetsusai Kondo, both of Hamamatsu, Japan

[73] Assignee: Kabushiki Kaisha Kawai Gakki Seisakusho, Shizuoka, Japan

[21] Appl. No.: 172,891

[22] Filed: Dec. 27, 1993

[30] Foreign Application Priority Data

Jan. 14, 1993 [JP] Japan ..... 5-020765

[51] Int. Cl.[6] ..... G10H 1/18; G10H 1/46

[52] U.S. Cl. ..... 84/615; 84/626; 84/633; 84/DIG. 7

[58] Field of Search ..... 84/615-620, 84/626-633, DIG. 7

[56] References Cited

U.S. PATENT DOCUMENTS 4,875,400 10/1989 Okuda et al. ..... 84/626

5,308,917 5/1994 Kitamura et al. ..... 84/615 X

*Primary Examiner*—Stanley J. Witkowski

*Attorney, Agent, or Firm*—Oliff & Berridge

[57] ABSTRACT

A play data recording apparatus for a keyed musical instrument converts keying strength information, which is detected by an appropriate detector when one of keys of a keyboard apparatus is operated, into reference keying strength information based on the relationship obtained in advance between keying strength information detected when one of the keys of the keyboards is operated at an arbitrary one or ones of fractionized reference sound volumes and reference keying strength information obtained by digitizing the fractionized reference sound volumes, and then causes the reference keying strength information obtained by the conversion to be stored as one of play data into a storage device.

16 Claims, 6 Drawing Sheets

FIG.6

| | | |
|---|---|---|
| TYPE OF EVENT | 90h | EVENT 1 |
| KEY NUMBER | n | |
| REFERENCE KEYING STRENGTH INFORMATION | S1 | |
| TIME | T1 | |
| TYPE OF EVENT | 90h | EVENT 2 |
| KEY NUMBER | m | |
| REFERENCE KEYING STRENGTH INFORMATION | S2 | |
| TIME | T2 | |
| TYPE OF EVENT | 80h | EVENT 3 |
| KEY NUMBER | n | |
| REFERENCE KEYING STRENGTH INFORMATION | 0 | |
| TIME | T3 | |
| TYPE OF EVENT | 80h | EVENT 4 |
| KEY NUMBER | m | |
| REFERENCE KEYING STRENGTH INFORMATION | 0 | |
| TIME | T4 | |

PLAY DATA RECORDING APPARATUS FOR KEYED MUSICAL INSTRUMENT

BACKGROUND OF THE INVENTION

1. Field of the Invention

This invention relates to a play data recording apparatus for a keyed musical instrument for recording a musical performance of a keyed musical instrument such as a piano as play data onto a storage medium.

2. Description of the Prior Art

An automatic playing musical instrument such as an automatic playing piano which has been put into practical use in recent years commonly includes a play data recording apparatus and a play data reproduction apparatus. The play data recording apparatus produces play data in accordance with the outputs of sensors for detecting on/off operations and strengths of keying operations of keys and records the play data onto a storage medium such as a floppy disk. The play data reproduction apparatus reads out the play data recorded on the storage medium and drives solenoids for driving the keys in accordance with the play data thus read out to effect a musical performance.

In the play data recording apparatus, keying strength information detected by the sensors is stored as play data onto a storage medium of the recording apparatus. Since the keying strength depends upon the key operating speed, the key operating pressure or a like parameter, a measurement amount corresponding to the time of a keying operation, i.e., an operation of a key, the speed of the keying operation, the key operating pressure and/or a like parameter or parameters will be hereinafter referred to as keying strength information. Meanwhile, in the play data reproduction apparatus, the driving powers to the solenoids are determined so that, when the keying strength information is applied to them, they perform same keying operations as upon recording. Thus, upon reproduction, the play data stored on the storage medium are read out to operate the solenoids so that those keys which were operated upon recording are operated with the same strengths as upon recording.

With the above construction, a problem arises in that where the mounting positions or the detection method of the keying strength detection sensors mounted on the recording apparatus is changed, even if a keying operation takes place with a same strength, keying strength information detected is different. Consequently, if the reproduction apparatus remains as it was, keying strengths upon automatic playing are different from those upon recording, and accordingly, accurate reproduction of a musical performance cannot be achieved. Therefore, in order to reproduce a musical performance accurately, the design of the play data reproduction apparatus must be changed. Further, where the sensors or the detection method is different, since the keying strength information of play data recorded by the play data recording apparatus is different, the play data are not compatible and cannot be reproduced correctly by another automatic playing musical instrument having different sensors.

SUMMARY OF THE INVENTION

It is an object of the present invention to provide a play data recording apparatus for a keyed musical instrument which can record, even when different sensors are used due to a design change or from a like cause, compatible play data without changing the design of the play data reproduction apparatus.

In order to attain the object described above, according to the present invention, there is provided a play data recording apparatus for a keyed musical instrument of the type which includes a keyboard apparatus having a plurality of keys, a detector responsive to an operation of any of the keys for detecting musical sound information at least including sound pitch information and keying strength information, play data production structure for producing play data in response to musical sound information detected by the detector, and a storage device for storing play data produced by the play data production structure, comprising a converter for converting keying strength information, which is detected by the detector when one of the keys of the keyboard apparatus is operated, into reference keying strength information based on a relationship obtained in advance between keying strength information detected when one of the keys of the keyboards is operated at one, some or all of fractionized reference sound volumes and reference keying strength information obtained by digitizing the fractionized reference sound volumes, and structure for causing reference keying strength information obtained by conversion of the converter to be stored as one of the play data into the storage device.

Here, the reference keying strength information is provided as one of a plurality of values obtained by digitization of a large number of fractionized reference sound volumes, and any of sound volumes of a musical performance of the keyboard is represented by one of the values of the reference keying strength information.

When the play data recording apparatus for a keyed musical instrument according to the present invention is played, keying strength information detected by the detector is converted into reference keying strength information by the converter and recorded as play data into the storage device. The reference keying strength information is provided as one of a plurality of values obtained by digitization of predetermined sound volumes which make a reference, and is not influenced even if different sensors are employed for the detector of the play data recording apparatus for a keyed musical instrument. Consequently, for an equal keying strength, same reference keying strength information is recorded as play data. Where the relationship between reference keying strength information and electric powers to solenoids of a play data reproduction apparatus for driving the keys is set so that, when reference keying strength information is provided to the play data reproduction apparatus, a key is operated with a keying strength corresponding to the reference keying strength information, play data recorded on the play data recording apparatus can be reproduced on another automatic playing musical apparatus having a different play data recording apparatus without changing the design of a play data reproduction apparatus of the automatic playing apparatus. In other words, the compatibility of play data is assured.

The above and other novel features and advantages of the present invention are described in or will become apparent from the following detailed description of a preferred embodiment.

BRIEF DESCRIPTION OF THE DRAWINGS

The preferred embodiment will be described with reference to the drawings, wherein like elements have been denoted throughout the figures with like reference numerals, and wherein:

FIG. 6 is a diagrammatic view illustrating data stored in a buffer memory of the play data recording apparatus shown in FIG. 5.

DESCRIPTION OF THE PREFERRED EMBODIMENT

Figure 1:
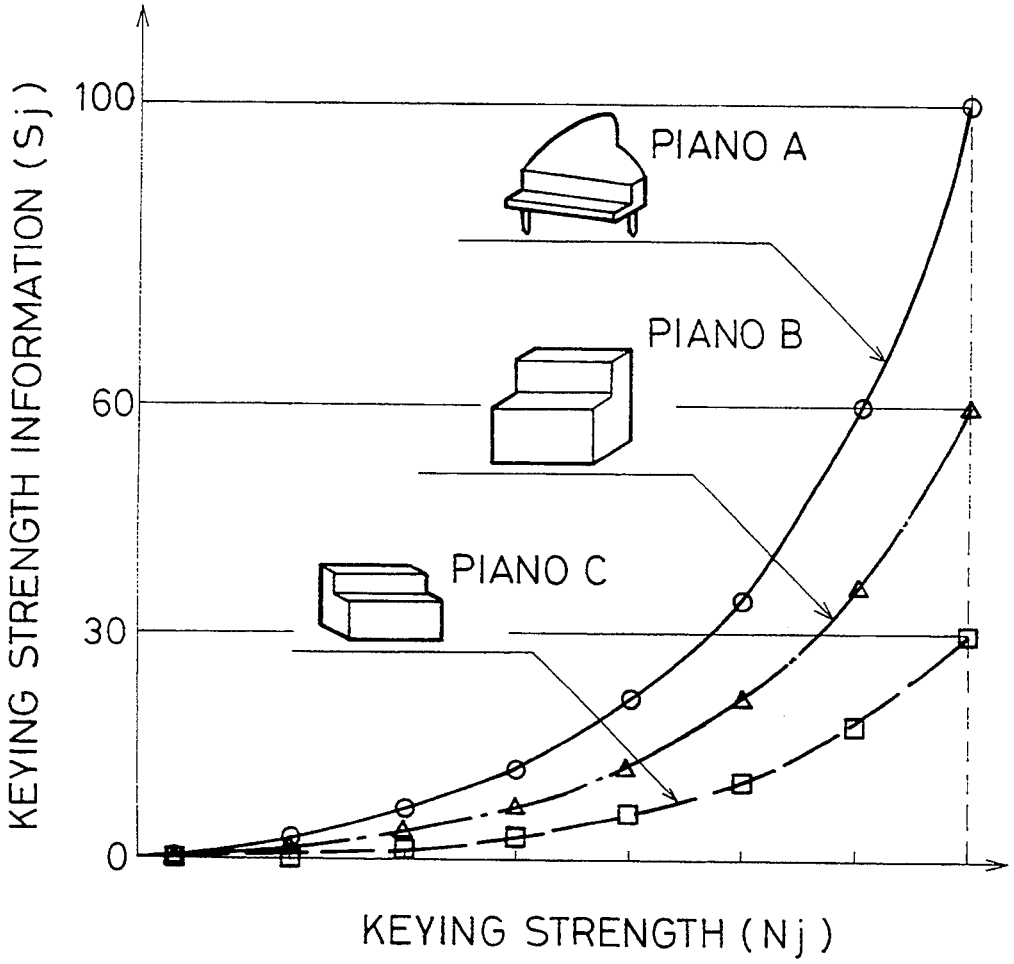
FIG. 1 is a graph illustrating the relationship between the keying strength and the keying strength information.

A play data recording apparatus for a keyed musical instrument according to the present invention will be described below. While the following description relates to a piano with a play data recording apparatus such as an automatic playing piano or a play data recording piano, the present invention is not limited to them and may be applied to any keyed musical instrument which has a play data recording apparatus or function.

First, conventional automatic playing pianos and an automatic playing piano according to the present invention (that is, an automatic playing piano provided with a play data recording apparatus according to the present invention) are compared with each other in regard to the compatibility of play data.

1. Compatibility of Play Data

1—1. Conventional Automatic Playing Piano

First, three conventional automatic playing pianos of different sensors for detecting keying strength information are considered. Here, the automatic playing pianos are represented as piano A′, piano B′ and piano C′. The range of keying strength information to be detected is 0 to 100 for the piano A′, 0 to 60 for the piano B′, and 0 to 30 for the piano C′. Each of the pianos A′ to C′ allows reproduction with a same sound volume as upon recording when recording and reproduction are performed with the same piano. However, play data have no compatibility among automatic playing pianos among which, even if keying takes place with the same strength, keying strength information detected is different and in which such keying strength information is recorded as it is as play data. In particular, while the play data recording apparatus, for example, of the piano C′ records the keying strength information of "30" for a keying operation at which a maximum sound volume is produced, the play data reproduction apparatus of the piano B′ records the keying strength information of "60" for a keying operation at which a maximum sound volume is produced. Consequently, if play data recorded from the piano C′ are reproduced on the piano B′, then only a sound volume which is about one half the sound volume to be reproduced naturally is produced. In this manner, conventional automatic playing pianos have no compatibility of play data where they are different in type.

1-2. Automatic Playing Piano According to the Invention

Automatic playing pianos according to the present invention wherein the keying strength information detection sensors of the conventional pianos A′, B′ and C′ are employed are considered here and will be represented as piano A, piano B and piano C, respectively. The pianos A to C are different from the conventional pianos A′ to C′ in that each of them includes conversion means for converting keying strength information into reference keying strength information and such reference keying strength information is recorded as play data and that the play data reproduction apparatus provided in them are constructed such that, when same play data are supplied thereto, they perform a keying operation to produce the same sound volume. For a keying operation to produce the same sound volume, keying strength information of the pianos A to C is converted into the same reference keying strength information before it is recorded. Consequently, play data are compatible among the pianos A to C, and by whichever one of the pianos A to C the play data are recorded, the play data can be reproduced on the other two pianos.

2. Production of Conversion Means

As described above, the play data recording apparatus for a keyed musical instrument according to the present invention is characterized in that keying strength information detected by a sensor when a key of a keyboard is operated is converted into reference keying strength information by conversion means and recorded as play data to assure the compatibility of play data. Accordingly, the sufficient assurance of the compatibility of play data relies upon how to produce the conversion means. Thus, the method of producing the conversion means will be described.

2-1. Relationship between Reference Keying Strength Information and Keying Strength Information FIG. 1 illustrates the relationship between the keying strength upon operation of a key of the keyboard on each of the pianos A, B and C described above and the keying strength information Sj detected upon keying. In FIG. 1, the keying strength of the axis of abscissa is represented in reference keying strength information Nj. As described hereinabove, the reference keying strength information is a value or values obtained by digitization of a sound volume or volumes which make a reference. Accordingly, if a key of a certain piano with a play data recording apparatus is operated by a plurality of times varying the keying strength and it becomes clear to which reference keying strength information the keying strengths correspond, then such a relationship between the reference keying strength information Nj and the keying strength information Sj as illustrated in FIG. 1 can be obtained. Then, if a conversion table for converting the keying strength information Sj to the reference keying strength information Nj is produced from the relationship, then conversion means for converting keying strength information into reference keying strength information can be produced readily.

In particular, a player of the piano performs eight keying operations to generate basic sound volumes (eight basic sound volumes from ppp=piano pianissimo to fff=forte fortissimo), and keying strength information Sj (j=1 to 8) detected then is recorded. The reference keying strength information Nj is obtained by fractionizing the basic sound volumes, and if a basic sound volume is determined, then reference keying strength information is determined and consequently graduations on the axis of abscissa and the axis of ordinate in FIG. 1 are determined. Accordingly, points can be plotted in FIG. 1. Then, from the points obtained in this manner, the relationship between the keying strength information Sj and the reference keying strength information Nj is obtained, and a conversion table for conversion from the keying strength information Sj to the reference keying strength information Nj is obtained.

The embodiment of the present invention which will be hereinafter described, however, does not employ the method described above. The reason is that the method is inferior in reproducibility of keying operations depending upon the physical condition or the feeling of the player, and stabilized conversion means may not possibly be obtained.

2-2. Method of Producing Conversion Means in the Present Embodiment

The present embodiment adopts the following method. In particular, according to the method, a keying strength at which a basic sound volume is produced is first determined in advance as a keying height Hj of a keying unit which is an objectively definite amount, and then a key of a piano with play data recording apparatus for which conversion means is to be provided is operated at a predetermined keying height using the keying unit to determine the relationship between the keying strength information Sj and the reference keying strength information Nj. In the following, the method will be described in three sections including 2—2-1. how to determine the keying height of the keying unit at which a basic sound volume is produced, 2—2—2. how to determine the relationship between the keying height of the keying unit and the keying strength information, and 2—2-3. how to produce a conversion table.

2—2-1. How to Determine the Keying Height of the Keying Unit at which a Basic Sound Volume Is Produced The procedure of determining the keying height of the keying unit at which a basic sound volume is generated is illustrated in the block diagram of FIG. 2. An outline of the procedure will be described below with reference to FIG. 2.

Figure 2:
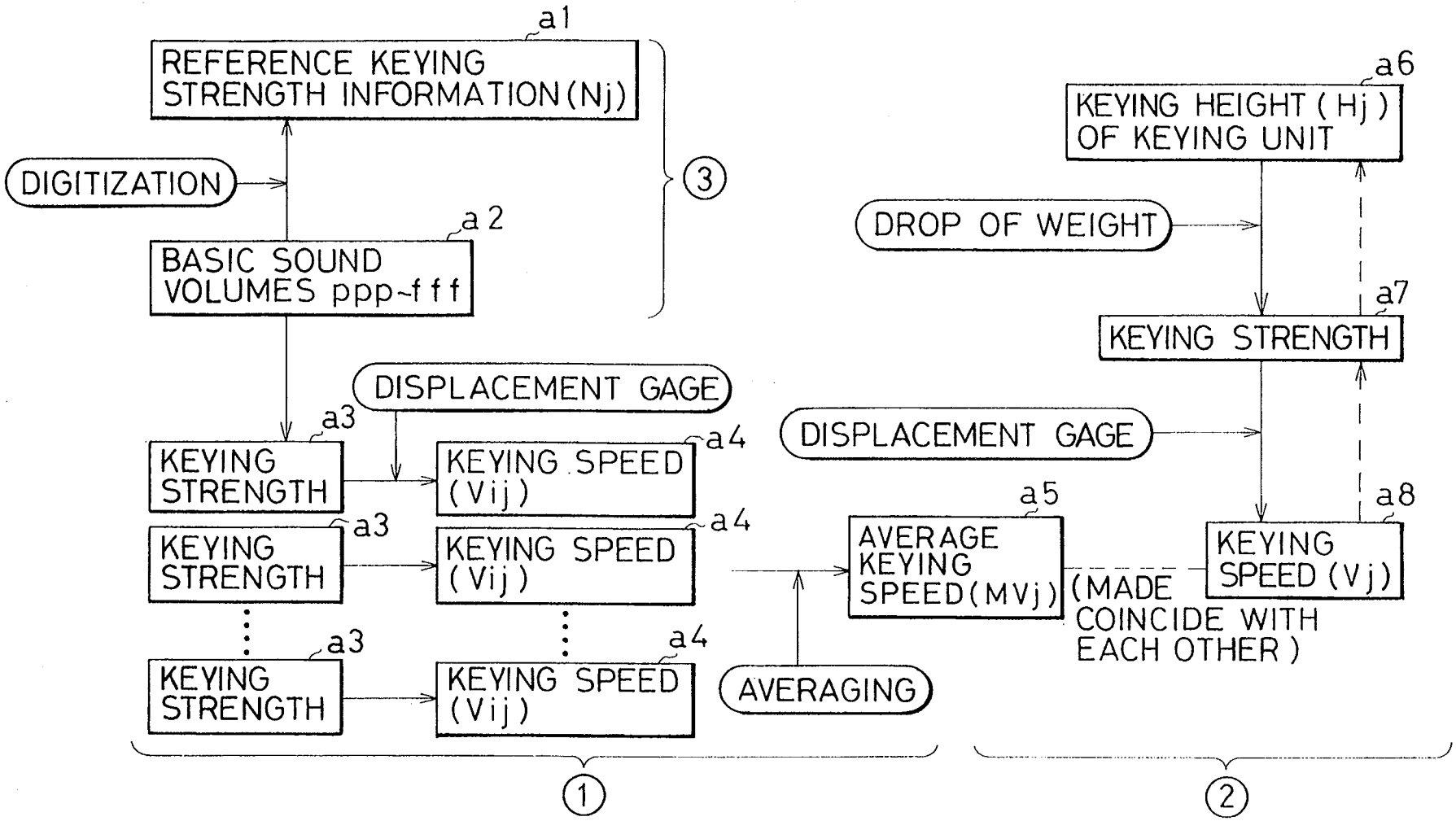
FIG. 2 is a block diagram illustrating the procedure of determining a keying height of a keying unit for producing a basic sound volume.

[1] If a plurality of players operate a plurality of pianos (which are not limited to automatic playing pianos but may be common pianos) at keying strengths (at step a3 in FIG. 2 at which basic sound volumes (at step a2 in FIG. 2) are produced, then keying speeds Vij (i=1 to n and j=1 to 8, at step a4 in FIG. 2) are obtained for the different keying strengths. Here, n is a total number of keying operations performed to produce a same basic sound volume.

[2] The keying speeds Vij obtained at the process [1] are averaged for each basic sound volume to obtain average keying speeds MVj (j=1 to 8, at step a5 in FIG. 2).

Figure 3:
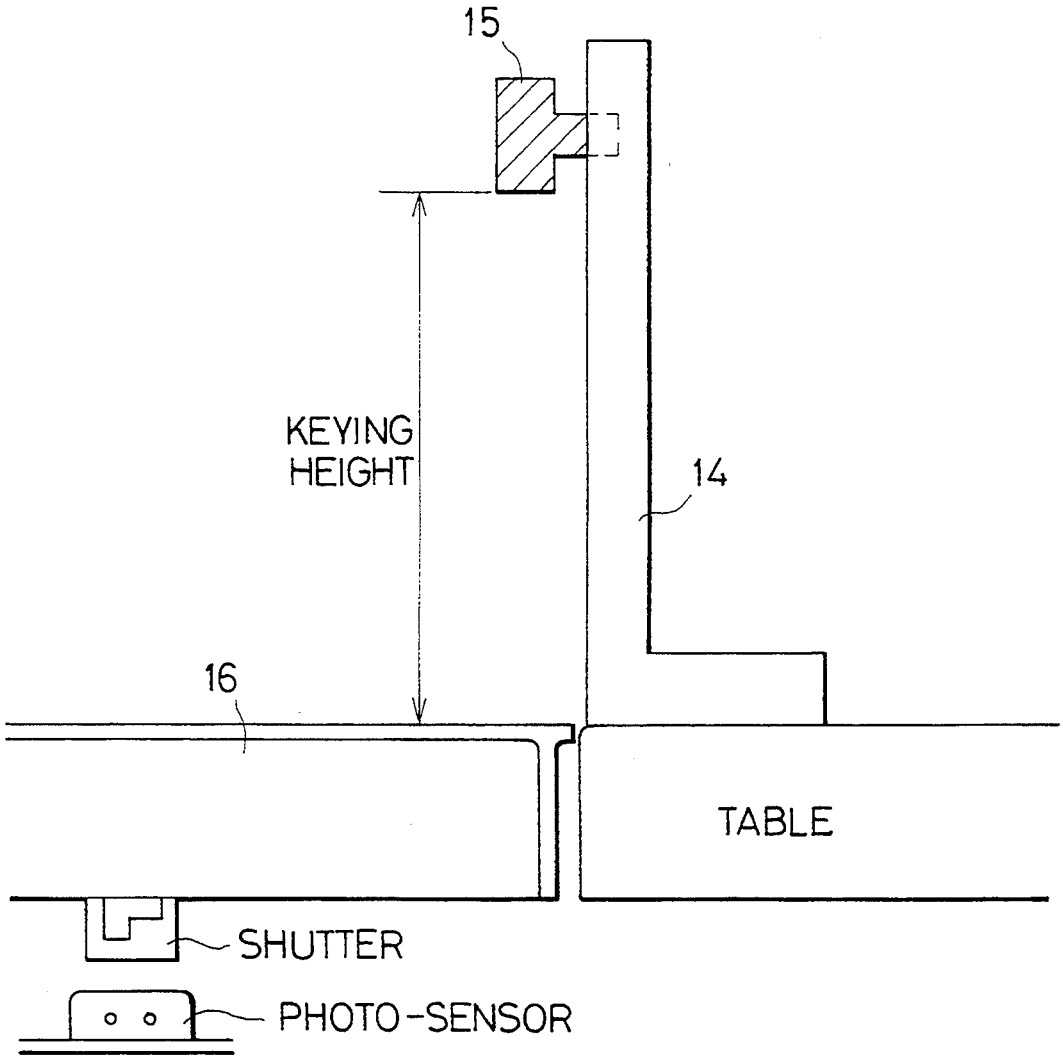
FIG. 3 is a schematic view showing a detailed construction of a keying unit.

[3] Using such a keying unit 14 as shown in FIG. 3, a key 16 of the keyboard of an arbitrary one of the pianos used in the process [1] above varying the keying height (height of a weight 15) is used to determine a keying height Hj (at step a6 in FIG. 2) of the keying unit 14 so that the keying speed Vj of the keying unit 14 may be equal to a corresponding one of the average keying speeds MVj. Keying heights Hj (j =1 to 8) of the keying unit 14 at which the eight basic sound volumes are generated are determined in this manner. It is to be noted that the keying unit 14 will be hereinafter described in more detail.

[4] Since reference keying strength information Nj (at step a1 in FIG. 2) is values obtained by fractionizing basic sound volumes and digitizing, the reference keying strength information representative of the eight basic sound volumes is determined in advance.

[5] Accordingly, from the relationship between the reference sound volumes determined in the process [3] and the keying heights of the keying unit 14 and the relationship between the basic sound volumes in the process [4] and the reference keying strength information, keying heights Hj of the keying unit 14 related to the reference keying strength information Nj are determined.

Of the procedure of the processes [1] to [5],

① how to determine a keying strength at which a basic sound volume is produced (process [1], [2]);

② how to operate a key with the keying unit (process [3]); and

③ the relationship between a basic sound volume and reference keying strength information (process [4]) will be described in more detail below (for the numbers ①, ② and ③, refer to FIG. 2).

2—2-1—1. Settlement of the Keying Strength at which a Basic Sound Volume Is Produced The keying strengths at which the basic sound volumes represented by the stress symbols ppp to fff are different among different players, and even if the player is the same, the keying strengths are different if different pianos are used. Consequently, if a particular player operates a key of a particular piano so as to produce a basic sound volume and the relationship between the basic sound volume and the keying strength then is used to produce conversion means for converting keying strength information into reference keying strength information, then the conversion means is low in reproducibility. Therefore, the present embodiment employs a specific method which eliminates an influence of a player or a piano used as much as possible so that same conversion means may normally be obtained stably. In particular, a number of players operate keys of a plurality of pianos so as to produce the eight basic sound volumes of ppp, pp, . . . , ff and fff, and average values (average keying speeds to produce the basic sound volumes MVj, at step a5 in FIG. 2) of the keying speeds detected then are determined for the individual basic sound volumes. The keying speeds at which the basic sound volumes are produced are settled in this manner.

A keying speed is detected from the outside by means of an optical displacement gage (by Zimmer, Germany and the like) which optically detects a displacement of a mark applied to a front portion of a key of the keyboard. Accordingly, the piano to be used for the measurement may be a common piano which does not include a keying strength information detection sensor.

Here, an average value is used because of the following reasons.

① Since the keying strengths at which the basic sound volumes of ppp, pp, . . . , ff and fff are produced are different among different individuals, an influence of such difference must be eliminated.

② Since the relationship between the keying strength and the volume of sound produced then varies among different types of pianos or among pianos of the same type, such difference must be eliminated.

Consequently, a personal influence and an influence of the type or the accuracy in production of a piano is eliminated from the succeeding conversion procedure.

2—2-1-2. Keying Method by the Keying Unit

FIG. 3 shows an example of a keying unit. Referring to FIG. 3, the keying unit generally denoted at 14 is generally constructed such that a weight 15 having a predetermined mass sufficient to make it possible to ignore an influence of a reactive force of the keyboard of an individual piano falls freely from an arbitrary keying height to operate a key 16 of the keyboard.

Since the weight 15 of the keying unit 14 is so heavy that an influence of a reactive force of the keyboard of a piano can be ignored, if the keying height of the keying unit 14 is equal, an equal keying speed is obtained for any piano. Accordingly, the relationship between the reference keying strength information and the keying height of the keying unit must only be determined once with an arbitrary piano.

Since the keying strengths at which the basic sound volumes are produced are settled as average keying speeds MVj (at step a5 in FIG. 2) based on the method of section 2—2-1-1 described above, a key of an arbitrary piano is operated with the keying unit 14 varying the keying height. The keying height, when the keying speed Vj (at step a8 in FIG. 2) detected upon such keying operation, coincides with a corresponding one of the average keying speeds MVj is found out and determined as a keying height Hj at which the basic sound volume is produced. Or alternatively, a key may be operated varying the keying height to find out the relationship between the keying height Hi and the keying speed Vi, and a keying height Hj may be determined from a point of an average keying speed MVj by interpolation.

2—2-1-3. Relationship between a Basic Sound Volume and Reference Keying Strength Information The relationship between a basic sound volume and reference keying strength information may be determined in any manner only if it is a one-by-one corresponding relationship. However, when compatibility with any other manufacturer is taken into consideration, preferably the relationship is based on a common criterion. Therefore, in the present embodiment, "1" of the velocity data of the MIDI standards is determined as ppp and "127" as fff, and the distance between them is equally divided into seven sections to determine the relationship between the basic sound volumes and the reference keying strength information Nj. The relationship between the basic sound volumes and the reference keying strength information Nj determined in this manner is shown in Table 1 below.

TABLE 1

| j | Basic Sound Volume | Reference Keying Strength Information Nj |
|---|---|---|
| 1 | ppp (piano pianissimo) | 1 |
| 2 | pp (pianissimo) | 19 |
| 3 | p (piano) | 37 |
| 4 | mp (mezzo piano) | 55 |
| 5 | mf (mezzo forte) | 73 |
| 6 | f (forte) | 91 |
| 7 | ff (fortissimo) | 109 |
| 8 | fff (forte fortissimo) | 127 |

It is to be noted that the determination of the reference keying strength information Nj between ppp and fff need not necessarily be limited to that of Table 1.

In summary, (1) First, a key is operated on a plurality of pianos by a plurality of players so as to generate the basic sound volumes, and average values MVj (j=1 to 8, at step a5 in FIG. 2) of the keying speeds detected then are calculated for the individual basic sound volumes.

(2) A key is operated on an arbitrary one of the pianos by means of a keying unit, and keying heights Hj (j=1 to 8, at step a6 in FIG. 2) of the keying unit are determined so that the keying speeds detected then may be equal to the average values MVj.

(3) Since the relationship between the basic sound volumes and the reference keying strength information Nj is determined in advance (refer to Table 1), the keying heights Hj of the keying unit related to the reference keying strength information Nj is determined from this relationship and the relationship determined in the process (2) above.

It is to be noted that, while the average keying speeds MVj and the keying heights Hj of the keying unit are determined for the eight basic sound volumes in the present embodiment, the present invention is not limited to this, and it is otherwise possible to determine average keying speeds at an arbitrary one or ones of reference sound volumes obtained by further fractionizing such basic sound volumes and determine keying heights of a keying unit.

Figure 4:
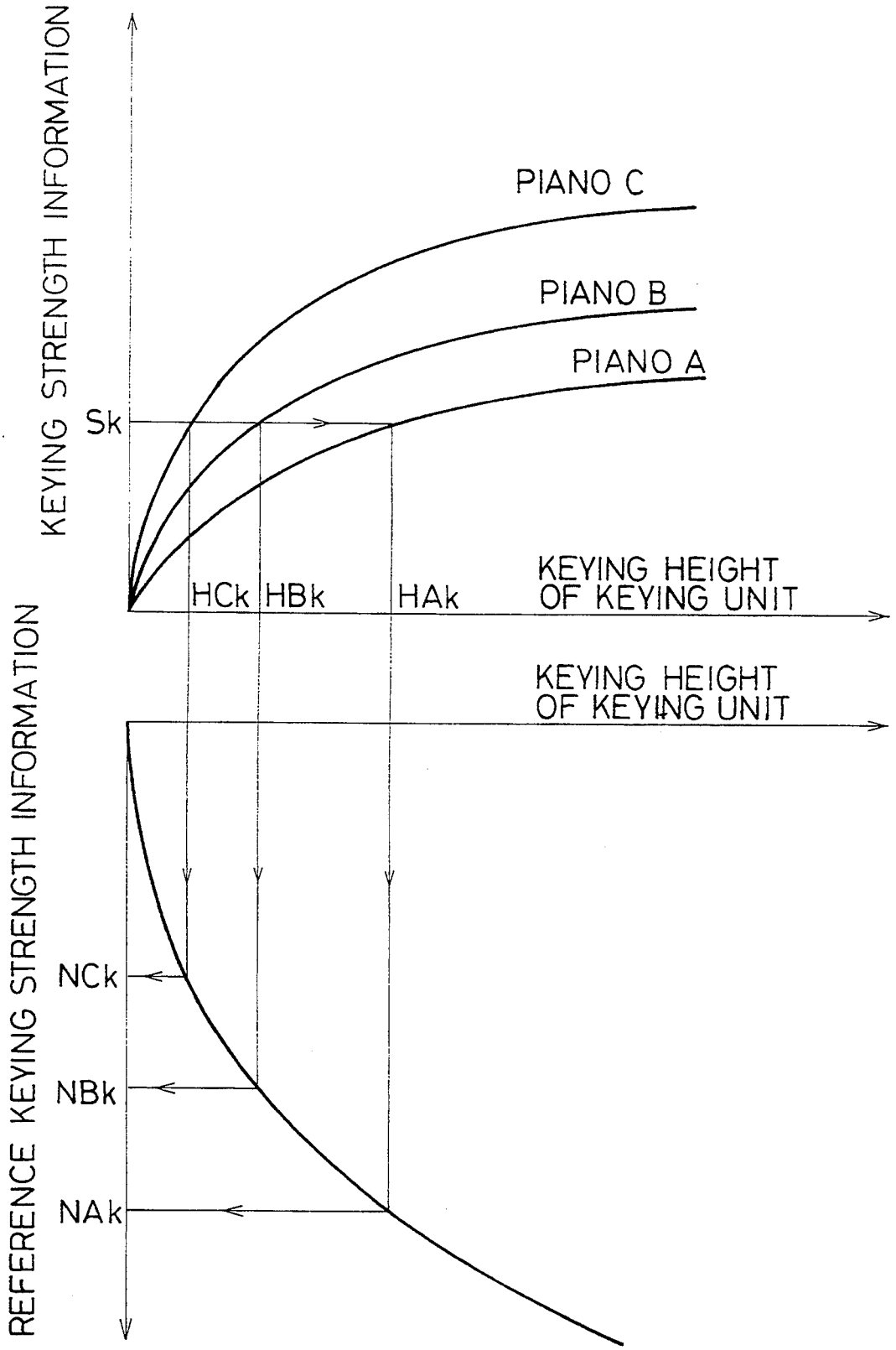
FIG. 4 is a graph illustrating the method of determining the relationship between the keying strength information and the reference keying strength information.

2—2—2. How to Determine the Relationship between a Keying Height of the Keying Unit and Keying Strength Information As described in section 2—2-1 above, once the keying heights Hj of the keying unit at which the basic sound volumes are produced are determined, the relationship between the keying heights Hj of the keying unit and the keying strength information Sj can be determined subsequently by keying, by means of the keying unit, a piano to which conversion means is to be provided. The relationship between the keying heights Hj of the keying unit and the keying strength information Sj is illustrated in the upper part of FIG. 4 with regard to the pianos A, B and C described hereinabove.

2—2—3. Production of a Conversion Table

The relationship between the reference keying strength information Nj and the keying heights Hj of the keying unit has been determined in section 2—2-1. The relationship is shown in the lower part of FIG. 4. The relationship between the keying strength information Sk and the reference keying strength information Nj can be obtained from the lower half of FIG. 4 and the upper half of FIG. 4 which has been described in section 2—2—2 above. How to determine the relationship will be described subsequently with reference to the upper and lower halves of FIG. 4. First, if certain keying strength information Sk is given, then the keying heights HAk, HBk and HCk of the keying unit are determined for the pianos A, B and C, respectively, from the upper part of FIG. 4. Then, the reference keying strength information NAk, NBk and NCk is determined from the keying heights HAk, HBk and HCk, respectively, using the lower part of FIG. 4. The relationship between the keying strength information Sk and the reference keying strength information NAk, NBk and NCk is determined in this manner. Consequently, a table for converting keying strength information into reference keying strength information can be produced from the relationship thus determined.

3. Present Embodiment

Figure 5:
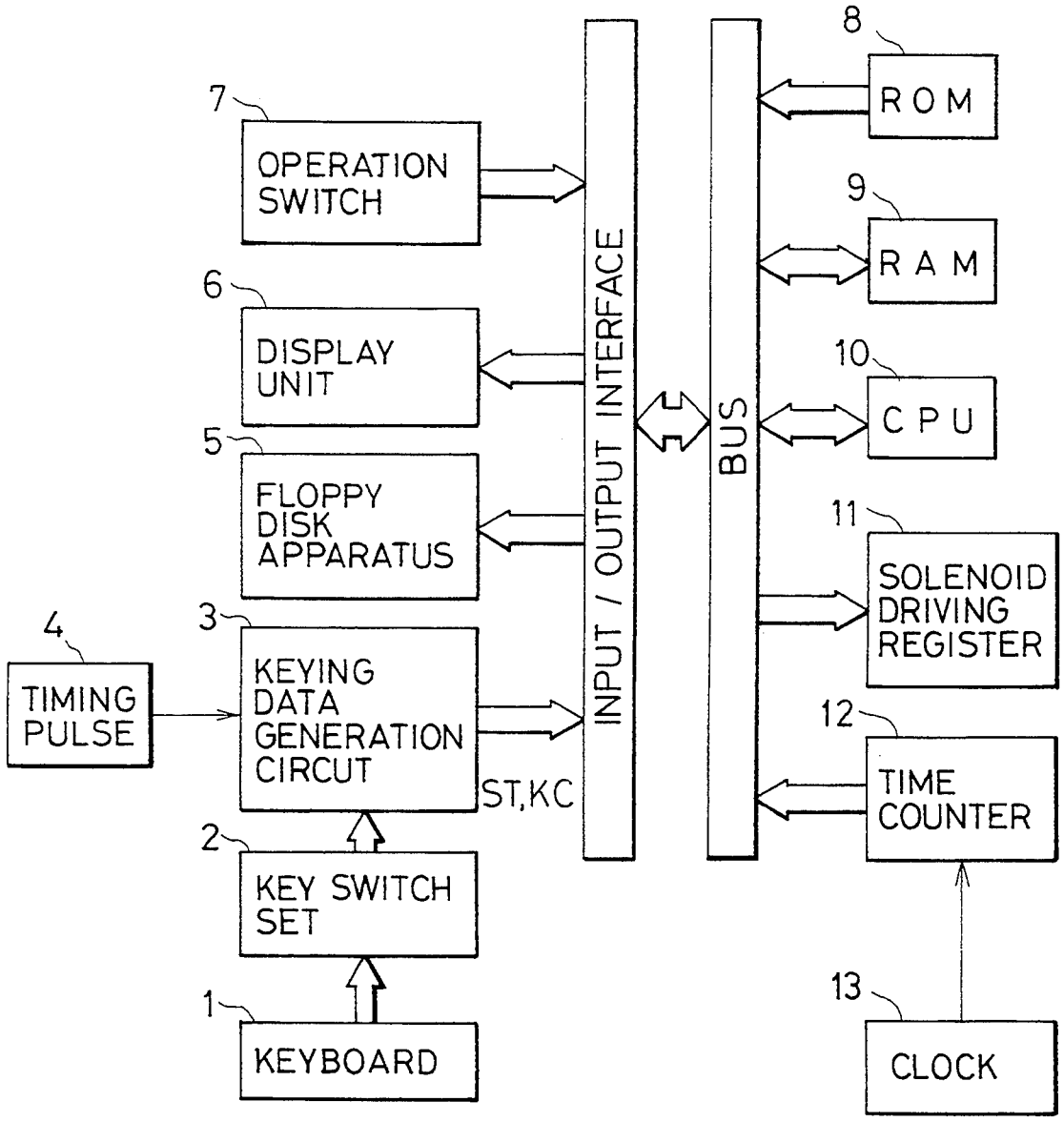
FIG. 5 is a block diagram showing a play data recording apparatus for a keyed musical instrument to which the present invention is applied.

FIG. 5 shows, in block diagram, the construction of a play data recording apparatus according to the present invention. Referring to FIG. 5, the play data recording apparatus includes a keyboard 1 of a piano. Though not shown, first and second key switches K1 and K2 for detecting an on/off operation and a keying strength of a key, respectively, are provided in parallel below each of keys of the keyboard 1. When a key is operated, the corresponding first key switch K1 is first turned on, and then the second key switch K2 is turned on. A key switch set 2 in FIG. 5 denotes an aggregate of the key switches described above.

A keying data generation circuit 3 scans the outputs of the key switches of the key switch set 2 to detect on/off states of the key switches. Then, when a certain key is operated, initial data are set to keying strength information ST (the keying strength information detected when a certain key is operated is denoted by ST) at the point of time when the first key switch K1 of the operated key is turned on, and until after the second key switch K2 is turned on, setting of ST to K*ST ($0<K<1$; consequently, as the time passes, the keying strength information ST becomes lower) is repeated for each predetermined period in response to a pulse generated by a timing pulse generator 4. Then at the point of time when the second key switch K2 is turned on, the keying strength ST and the key number KC of the key are outputted (in other words, in the present embodiment, a measurement amount corresponding to a keying speed is adopted as keying strength information).

On the other hand, when the key is released, reversely to that described above, the second key switch K2 is turned off first, and then the first key switch K1 is turned off. In this instance, whether the key is operated or released is identified from the order in which the states of the key switches vary (second to first) or the variation of the state (on to off). A result of the identification may be used such that the keying strength information ST when the key is released is set to "zero" or the identification information is added upon writing into a buffer memory which will be hereinafter described.

A central processing unit (CPU) 10 is provided for controlling components of the play data recording apparatus in accordance with a program stored in a read only memory (ROM) 8 and is connected to the components of the apparatus by way of a bus. A random access memory (RAM) 9 serves as a memory for temporarily storing data therein. The ROM 8 stores in advance the program, a conversion table for converting keying strength information ST into reference keying strength information NT (reference keying strength information corresponding to keying strength information ST is denoted by NT) and some other necessary data. The play data recording apparatus further includes a floppy disk unit 5, and a time counter 12 for counting the time.

4. Operation of the Play Data Recording Apparatus

Processing operation of the play data recording apparatus of the present embodiment will be described subsequently with reference to FIG. 5.

The CPU 10 periodically reads in a key number KC and keying strength information ST from the keying data generation circuit 3 and writes the data KC and ST thus read in into a working register in the RAM 9. In this instance, the CPU 10 converts the keying strength information ST into corresponding address data and supplies the address data to the ROM 8. The ROM 8 has the conversion table stored therein, and reference keying strength information NT corresponding to the keying strength information ST is read out from the ROM 8.

In this manner, keying strength information ST is converted into reference keying strength information NT, which is written as play data into the buffer memory in the RAM 9. Further, contents of the time counter 12 are written into the buffer memory of the RAM 9 at a location next to the key number KC and the reference keying strength information NT. Here, the contents of the time counter 12 represent time information TM when the event occurs. The condition of the buffer memory written in this manner is illustrated in FIG. 6.

Referring to FIG. 6, the condition of the buffer memory when two keys having key numbers n and m are operated is shown. The keys n and m are depressed in this order (events 1 and 2), and then the keys n and m are released in this order (events 3 and 4). When an event occurs, four pieces of information including the type of the event, the key number, reference keying strength information and the time are recorded. In the stored contents of the buffer memory illustrated in FIG. 6, the types of the events are represented by "90*h*" and "80*h*", wherein "90*h*" denotes an on-event while "80*h*" denotes an off-event. The suffix "h" denotes the hexadecimal notation.

While, in the foregoing description, the CPU 10 periodically reads in the contents of the keying data generation circuit 3, it may read in the contents of the keying data generation circuit 3 in a different manner, for example, such that, each time a variation occurs with the condition of the key switch set 2 and keying strength information ST and a key number KC are produced, the CPU 10 is interrupted to effect processing of data. It is to be noted that, if no event is detected when the CPU 10 reads out the contents of the keying data generation circuit 3, conversion of data or writing into the buffer memory is not performed. Then, at the point of time when a predetermined number of data are written into the buffer memory, the CPU 10 transfers the data in the buffer memory to the floppy disk apparatus 5 so that the data are written onto a floppy disk.

The play data written onto the floppy disk in this manner are reproduced by a reproduction apparatus. Of the play data, the information representative of the keying strength is the reference keying strength information NT which is standardized with respect to the keying height. Accordingly, also play data obtained using a different play data recording apparatus allow reproduction on a same reproduction apparatus of the same musical performance as upon recording.

It is to be noted that, while, in the embodiment described above, a keying strength is detected by means of the key switch set 2, the present invention can be applied naturally to detection of a sound volume by means of another sensor such as, for example, a microphone. Further, the present invention can be applied to a further case wherein a musical score is inputted by way of a keyboard or wherein musical sounds from a record are collected by way of a microphone and recorded as data.

Having now fully described the invention, it will be apparent to one of ordinary skill in the art that many changes and modifications can be made thereto without departing from the spirit and scope of the invention as set forth herein.

What is claimed is:

1. A play data recording apparatus for a keyed musical instrument, comprising:

a keyboard apparatus having a plurality of keys, detection means responsive to an operation of any of said keys for detecting musical sound information including at least sound pitch information and keying strength information, play data production means for producing play data in response to said musical sound information detected by said detection means, storage means for storing said play data produced by said play data production means, keying means for operating one of said keys of said keyboard apparatus at least one level of plural reference sound volumes, means for producing a conversion table for converting said keying strength information into reference keying strength information, wherein said converting of said keying strength information is detected when one of said keys of said keyboard apparatus is operated, said reference keying strength information being obtained by digitizing the reference sound volumes, conversion means for converting said keying strength information, which is detected by said detection means when one of said keys of said keyboard apparatus is operated, into said reference keying strength information using said conversion table, and means for storing said reference keying strength information obtained by said conversion means as one of the play data into said storage means, whereby compatible play data can be stored regardless of differences in mounting position, detection method and individual variation of sensors for detecting said keying strength information.

2. A play data recording apparatus for a keyed musical instrument according to claim 1, wherein the keying strength information represents one of keying strengths at which eight basic sound volumes from piano pianissimo to forte fortissimo are produced.

3. A play data recording apparatus for a keyed musical instrument according to claim 1, wherein the keying strength information is obtained as a keying height of a keying unit.

4. A play data recording apparatus for a keyed musical instrument according to claim 3, wherein the keying height is obtained from an average value of keying speeds obtained by operation of one of said keys of said keyboard apparatus by a plurality of players.

5. A play data recording apparatus for a keyed musical instrument according to claim 4, wherein the keying speeds are measured from outside by means of an optical displacement gage which optically detects a displacement of a mark applied to a front portion of one of said keys of said keyboard apparatus.

6. A play data recording apparatus for a keyed musical instrument according to claim 3, wherein said keying unit is constructed such that a weight having a predetermined mass sufficient to make it possible to ignore an influence of a reactive force of any of said keys of said keyboard apparatus drops freely from an arbitrary keying height to operate one of said keys of said keyboard apparatus.

7. A play data recording apparatus for a keyed musical instrument according to claim 1, wherein said detection means for detecting the musical sound information includes a key switch set including a plurality of first key switches disposed below said keys of said keyboard apparatus each for being turned on firstly when the corresponding key is operated and a plurality of second key switches disposed below said keys of said keyboard apparatus each for being turned on subsequently to the corresponding first key switch when the corresponding key is operated.

8. A play data recording apparatus for a keyed musical instrument according to claim 7, wherein said detection means for detecting the musical sound information further includes means for measuring, when any of said keys of said keyboard apparatus is operated, a time required after a corresponding one of said first key switches of said key switch set is turned on until a corresponding one of said second key switches of said key switch set is turned on to obtain keying strength information corresponding to a keying speed.

9. A play data recording apparatus for a keyed musical instrument, comprising:

a keyboard apparatus having a plurality of keys;

a detector communicating with said plurality of keys, said detector detecting musical sound information including at least sound pitch information and keying strength information in response to an operation of any of said keys;

a controller coupled to said detector, said controller producing play data in response to said musical sound information detected by said detector, said controller producing a conversion table for converting said keying strength information into reference keying strength information, said reference keying strength information being obtained by digitizing the reference sound volumes, wherein said controller converts said keying strength information into said reference keying strength information using said conversion table; and a memory communicating with said controller, said memory storing said reference keying strength information obtained by said controller.

10. A play data recording apparatus for a keyed musical instrument according to claim 9, wherein the keying strength information represents one of keying strengths at which eight basic sound volumes from piano pianissimo to forte fortissimo are produced.

11. A play data recording apparatus for a keyed musical instrument according to claim 9, wherein the keying strength information is obtained as a keying height of a keying unit.

12. A play data recording apparatus for a keyed musical instrument according to claim 11, wherein the keying height is obtained from an average value of keying speeds obtained by operation of one of said keys of said keyboard apparatus by a plurality of players.

13. A play data recording apparatus for a keyed musical instrument according to claim 12, wherein the keying speeds are measured from outside by an optical displacement gage which optically detects a displacement of a mark applied to a front portion of one of said keys of said keyboard apparatus.

14. A play data recording apparatus for a keyed musical instrument according to claim 11, wherein said keying unit is constructed such that a weight having a predetermined mass sufficient to make it possible to ignore an influence of a reactive force of any of said keys of said keyboard apparatus drops freely from an arbitrary keying height to operate one of said keys of said keyboard apparatus.

15. A play data recording apparatus for a keyed musical instrument according to claim 9, wherein said detector includes a key switch set including a plurality of first key switches disposed below said keys of said keyboard apparatus each for being turned on firstly when the corresponding key is operated and a plurality of second key switches disposed below said keys of said keyboard apparatus each for being turned on subsequently to the corresponding first key switch when the corresponding key is operated.

16. A play data recording apparatus for a keyed musical instrument according to claim 15, wherein said detector further includes a device for measuring, when any of said keys of said keyboard apparatus is operated, a time required after a corresponding one of said first key switches of said key switch set is turned on until a corresponding one of said second key switches of said key switch set is turned on to obtain keying strength information corresponding to a keying speed.

* * * * *